US009193061B1

(12) United States Patent
Lin

(10) Patent No.: US 9,193,061 B1
(45) Date of Patent: Nov. 24, 2015

(54) COLLISION-RESISTANT TOOL BOX

(71) Applicant: Chia-Szu Lin, Taichung (TW)

(72) Inventor: Chia-Szu Lin, Taichung (TW)

( * ) Notice: Subject to any disclaimer, the term of this patent is extended or adjusted under 35 U.S.C. 154(b) by 0 days.

(21) Appl. No.: 14/444,168

(22) Filed: Jul. 28, 2014

(51) Int. Cl.

| | |
|---|---|
| ***B25H 3/02*** | (2006.01) |
| ***B65D 25/28*** | (2006.01) |
| ***B65D 21/02*** | (2006.01) |
| ***B65D 81/02*** | (2006.01) |

(52) U.S. Cl.
CPC ..... *B25H 3/022* (2013.01); *B65D 21/0204* (2013.01); *B65D 25/2841* (2013.01); *B65D 81/02* (2013.01)

(58) Field of Classification Search
CPC .. B65D 11/16; B65D 11/1873; B65D 11/188; B65D 43/162; B65D 43/164–43/166; B65D 90/041; A45C 3/00; A45C 5/00; A45C 5/02; A45C 7/0036; A45C 11/20; A45C 13/008; A45C 13/02; A45C 13/021; A45C 13/1069; A45C 13/1076; A45C 13/1084; A45C 13/28; B65H 3/003; B65H 3/006; B65H 3/02; B65H 3/023; B65H 3/025; B65H 3/027–3/028; B65H 3/04
USPC ..... 206/349, 372, 373, 379, 393, 521; 220/23.83, 23.87–23.89, 4.01, 220/4.21–4.24, 4.27, 4.33–4.34, 761–763, 220/842, 843; 16/225, 383, 384; 190/100, 190/114–117
See application file for complete search history.

(56) References Cited

U.S. PATENT DOCUMENTS

| | | | | |
|---|---|---|---|---|
| 3,306,404 | A * | 2/1967 | Yellin | 190/110 |
| 3,881,580 | A * | 5/1975 | Doppelt | 190/114 |
| 5,096,030 | A * | 3/1992 | Espinosa et al. | 190/108 |
| 5,400,470 | A * | 3/1995 | Kammersgard | A45C 13/26 16/438 |
| 5,947,286 | A * | 9/1999 | Chau | 206/372 |
| 6,062,385 | A * | 5/2000 | Cho | 206/373 |
| 8,267,247 | B1 * | 9/2012 | Horiyama | 206/373 |
| 8,276,752 | B1 * | 10/2012 | Meng | 206/372 |
| 2002/0117413 | A1 * | 8/2002 | Ling | 206/373 |
| 2003/0075467 | A1 * | 4/2003 | Anderson et al. | 206/349 |
| 2004/0144671 | A1 * | 7/2004 | Hallee et al. | 206/373 |
| 2007/0138041 | A1 * | 6/2007 | Welsh | 206/349 |
| 2008/0060957 | A1 * | 3/2008 | Ford et al. | 206/350 |
| 2008/0237939 | A1 * | 10/2008 | McDonnough et al. | 264/500 |
| 2009/0065515 | A1 * | 3/2009 | Grinnall et al. | 220/675 |
| 2015/0021220 | A1 * | 1/2015 | Cheng | 206/372 |
| 2015/0060316 | A1 * | 3/2015 | Lee | 206/349 |
| 2015/0069076 | A1 * | 3/2015 | Liu | 220/759 |

* cited by examiner

*Primary Examiner* — Bryon Gehman
*Assistant Examiner* — Brijesh V. Patel
(74) *Attorney, Agent, or Firm* — Ming Chow; Sinorica, LLC

(57) ABSTRACT

A collision-resistant tool box has two bodies, a connecting set, a buckle set, and a handle. Each body has a side wall, a body space, and a collision-resistant space. The side wall is formed in a closed state. The body space is formed in the body. The bodies are mounted facing each other via the body spaces. The collision-resistant space is formed in the side wall along an extension direction of the side wall. The connecting set is connected to a side of each body and connected to the bodies. The buckle set is mounted on a side of each body opposite to the connecting set. The handle is mounted on the side of one of the bodies opposite to the connecting set. Therefore, the collision-resistant tool box can provide a collision-resistant effect.

6 Claims, 8 Drawing Sheets

COLLISION-RESISTANT TOOL BOX

BACKGROUND OF THE INVENTION

1. Field of the Invention

The present invention relates to a tool box, and more particularly to a collision-resistant tool box.

2. Description of Related Art

A tool box is used for storing tools. The conventional tool box has two bodies connected to each other, a handle, and a buckle set. The handle is mounted on one of the bodies and is provided for holding by a user. The buckle set is mounted on the bodies at a position opposite to the connecting junction between the bodies. The buckle set includes multiple buckle units. The bodies can be spread relative to each other to expose the inner spaces of the bodies. Alternatively, the bodies abut each other to close the tool box. When the bodies abut each other, the buckle units can fasten the bodies, such that the bodies can be combined with each other.

However, a side wall of each body is a solid structure, such that the body may be broken easily upon impact. The aforementioned problem has to be resolved.

SUMMARY OF THE INVENTION

The main objective of the present invention is to provide a collision-resistant tool box to resolve the aforementioned problem.

The collision-resistant tool box has two bodies, a connecting set, a buckle set, and a handle.

Each body has a side wall, a body space, and a collision-resistant space. The side wall is formed in a closed state. The body space is formed in the body, surrounded by the side wall, and has an opening located at a side of the body. The bodies are mounted facing each other via the body spaces, and the body spaces selectively communicate with each other. The collision-resistant space is formed in the side wall along an extension direction of the side wall.

The connecting set is connected to a side of each body and connected to the bodies.

The buckle set is mounted on a side of each body opposite to the connecting set.

The handle is mounted on the side of one of the bodies that is opposite to the connecting set.

Other objectives, advantages and novel features of the present invention will become more apparent from the following detailed description when taken in conjunction with the accompanying drawings.

DETAILED DESCRIPTION OF PREFERRED EMBODIMENT

Figure 1:
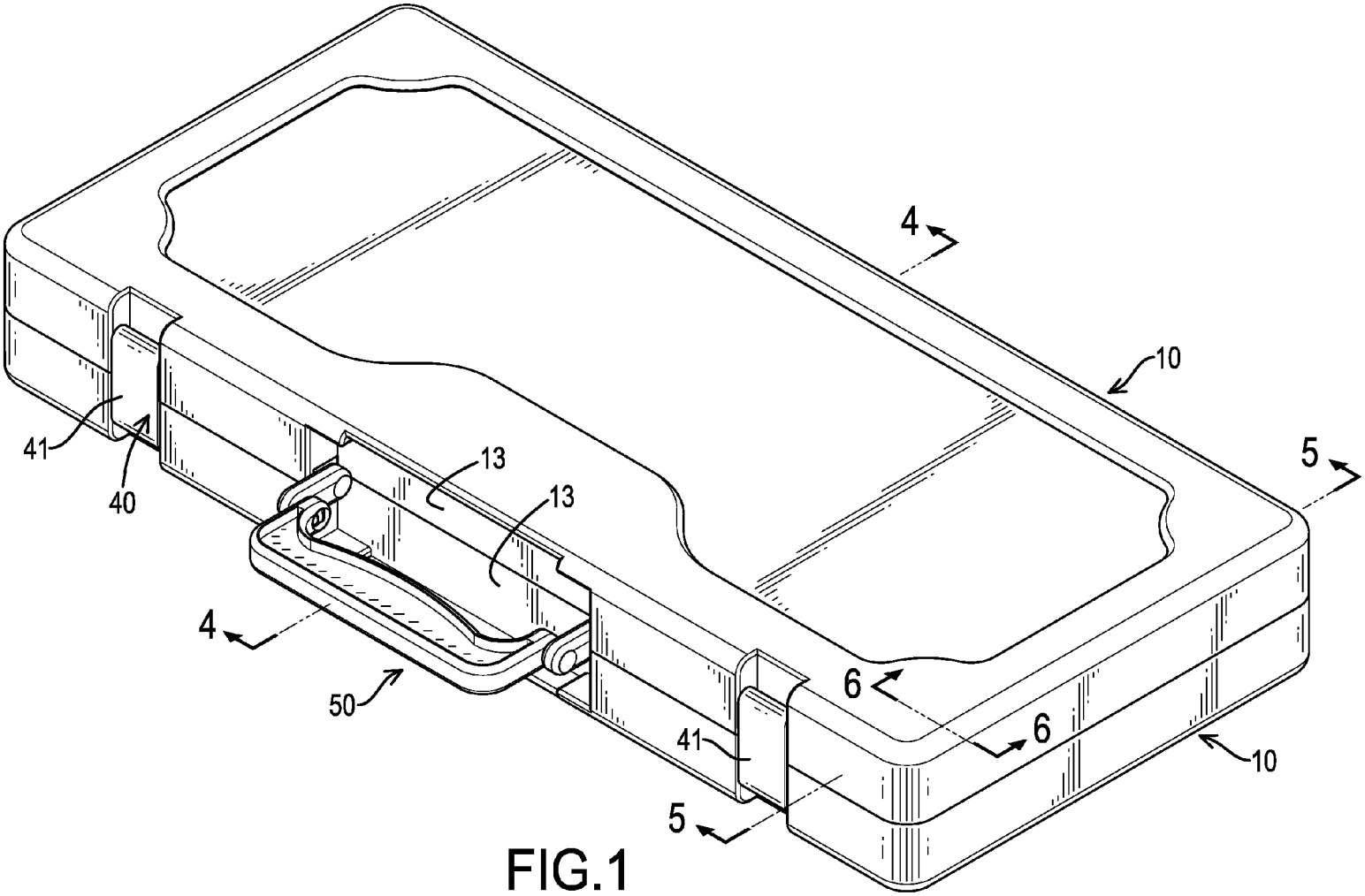
FIG. 1 is a perspective view of a preferred embodiment of a collision-resistant tool box in accordance with the present invention.
Figures 2A, 2B:
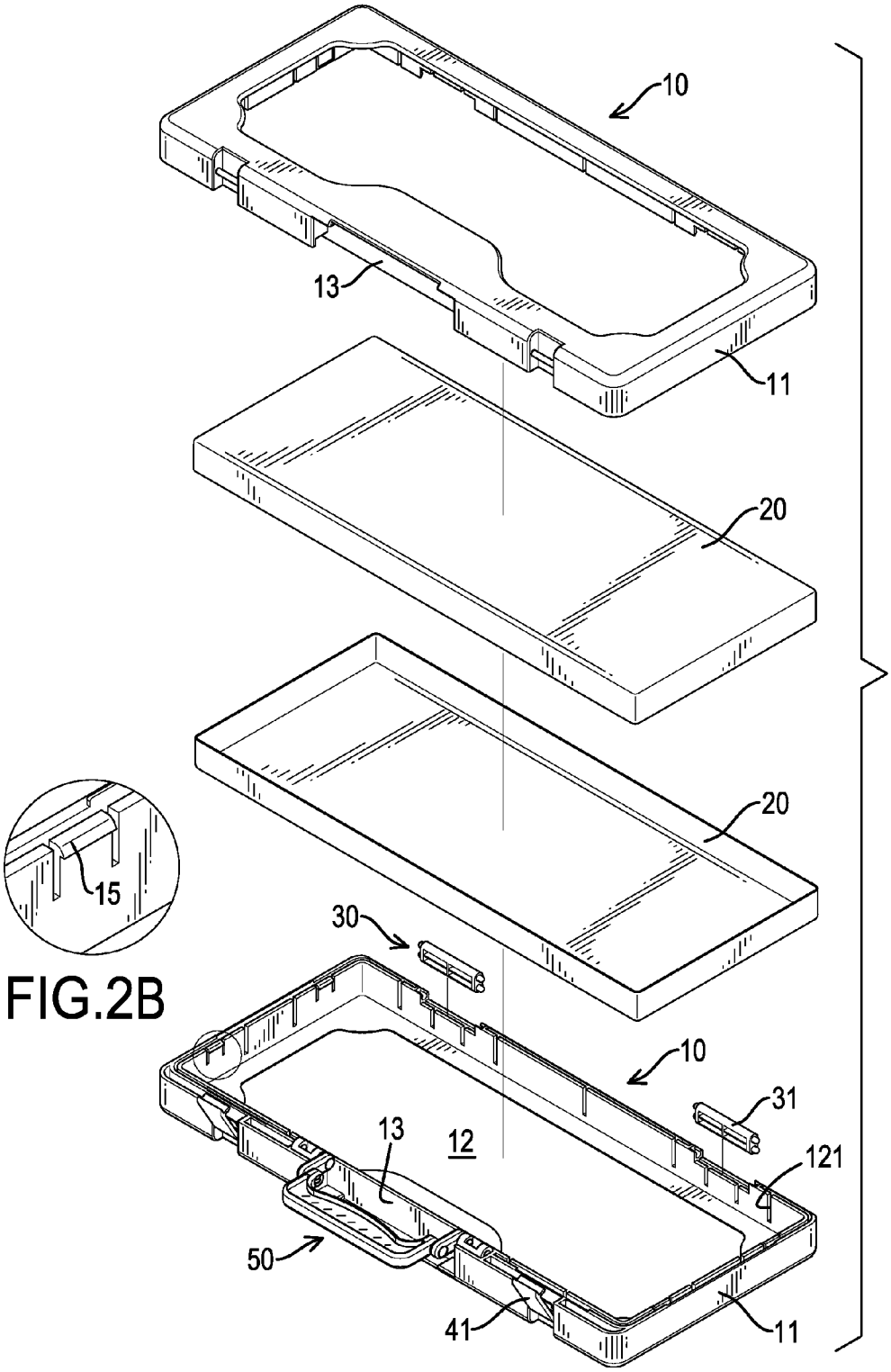
FIG. 2A is an exploded perspective view of the collision-resistant tool box in FIG. 1.
FIG. 2B is a partially enlarged perspective view of the collision-resistant tool box in FIG. 2A.
Figure 3:
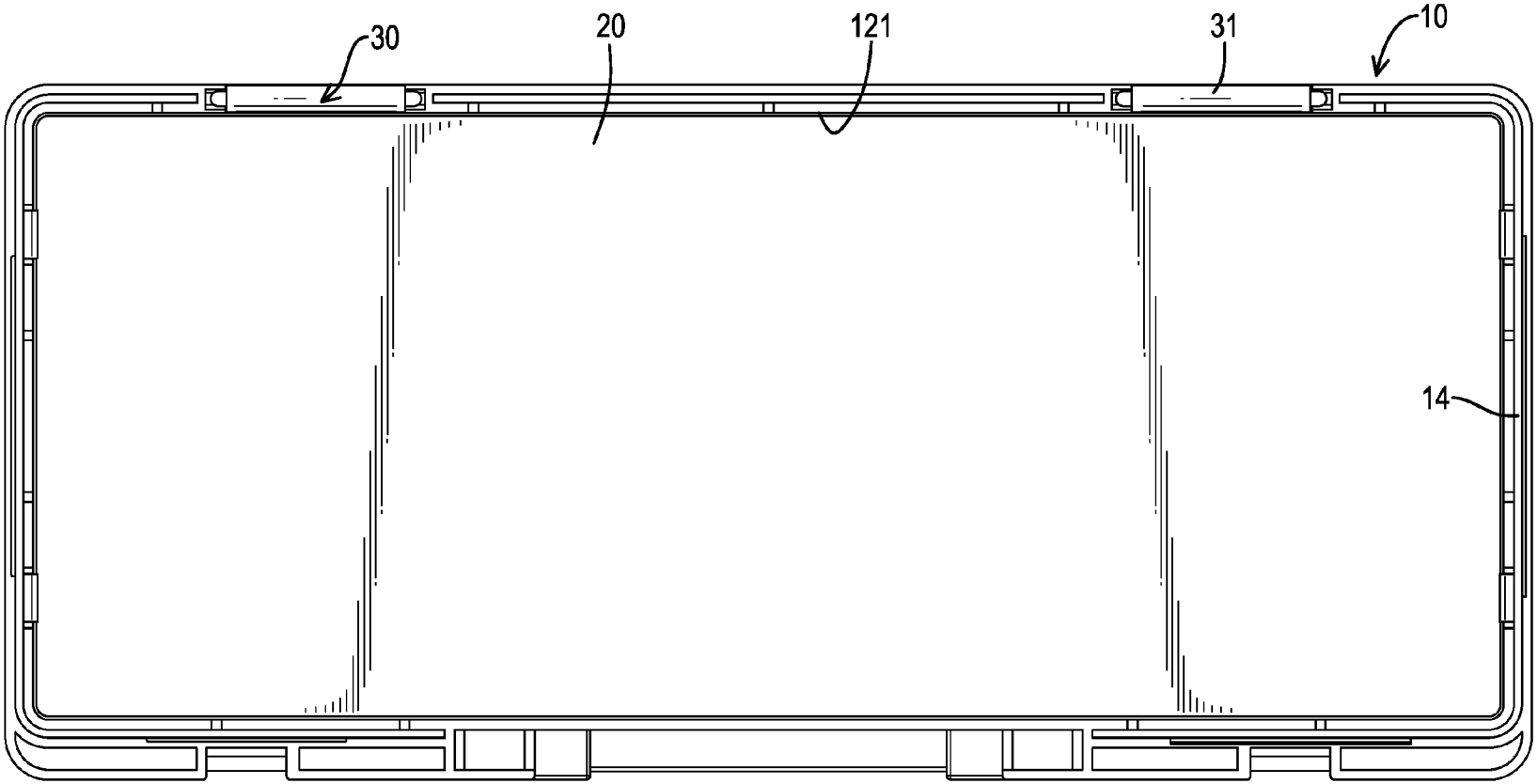
FIG. 3 is a top view of one of the bodies of the collision-resistant tool box in FIG. 1.
Figure 4:
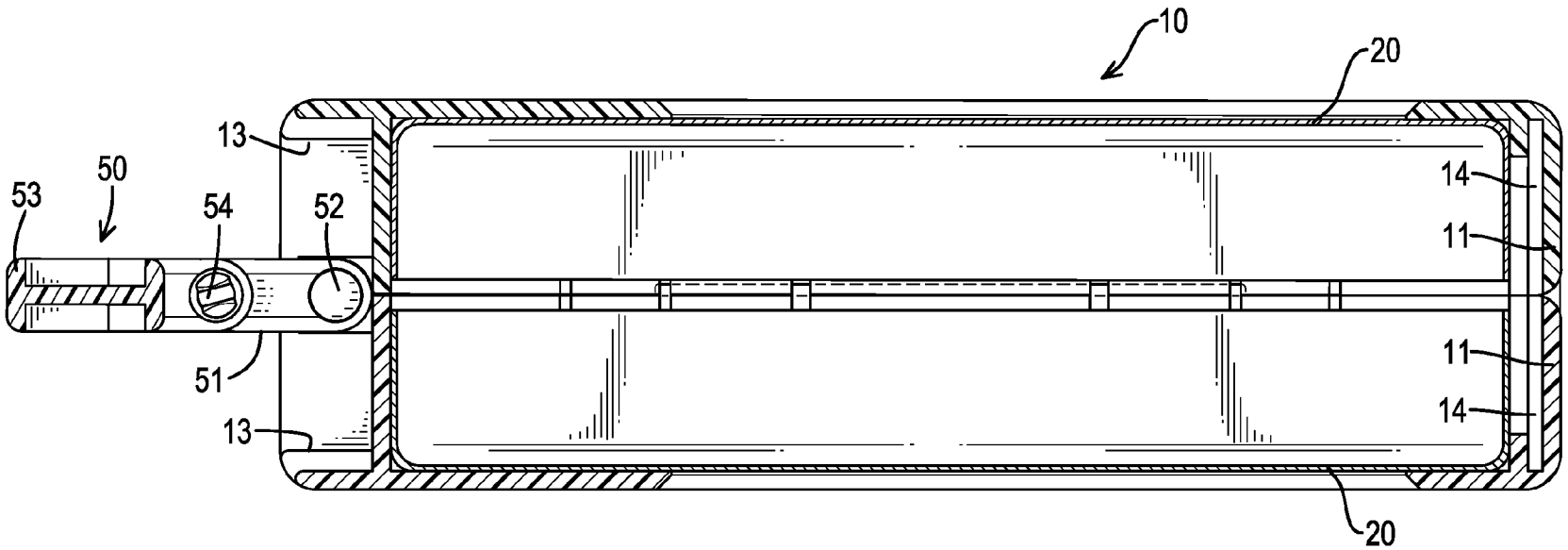
FIG. 4 is a cross sectional side view along the line 4-4 in FIG. 1.
Figure 5:
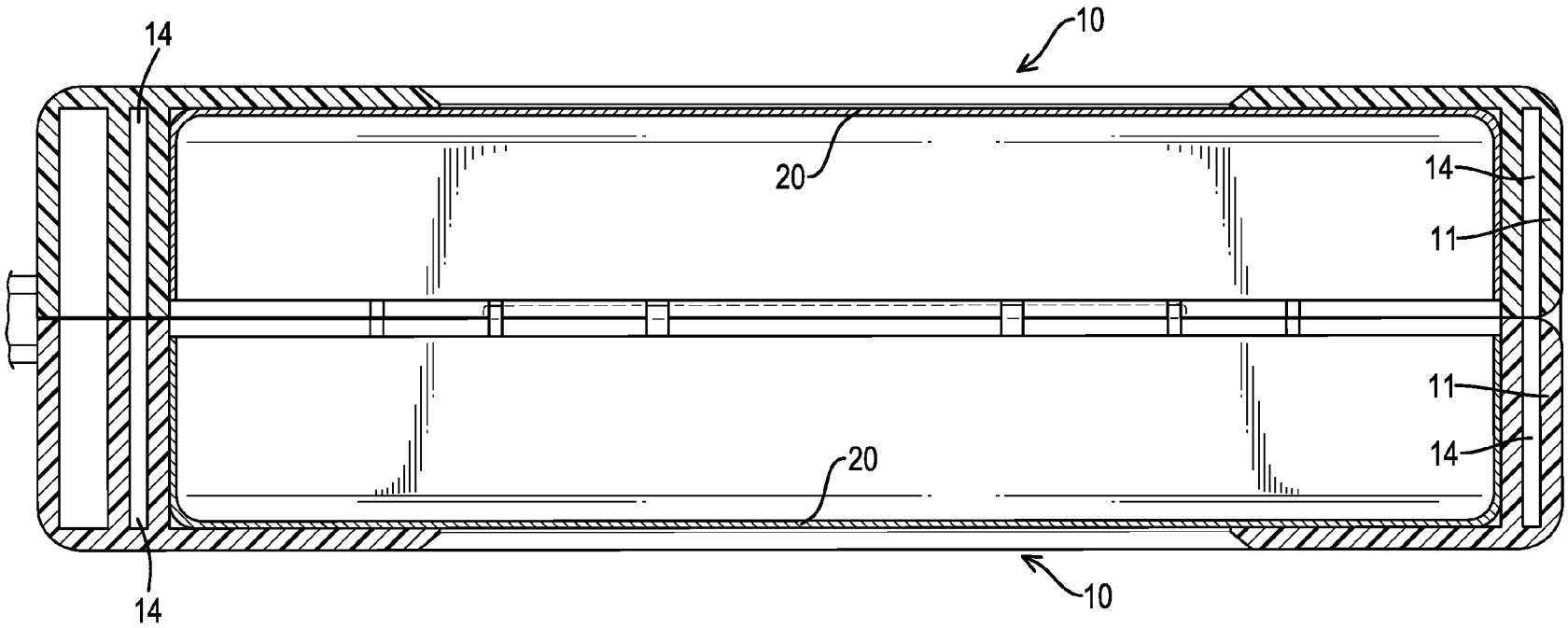
FIG. 5 is a cross sectional side view along the line 5-5 in FIG. 1.
Figure 6:
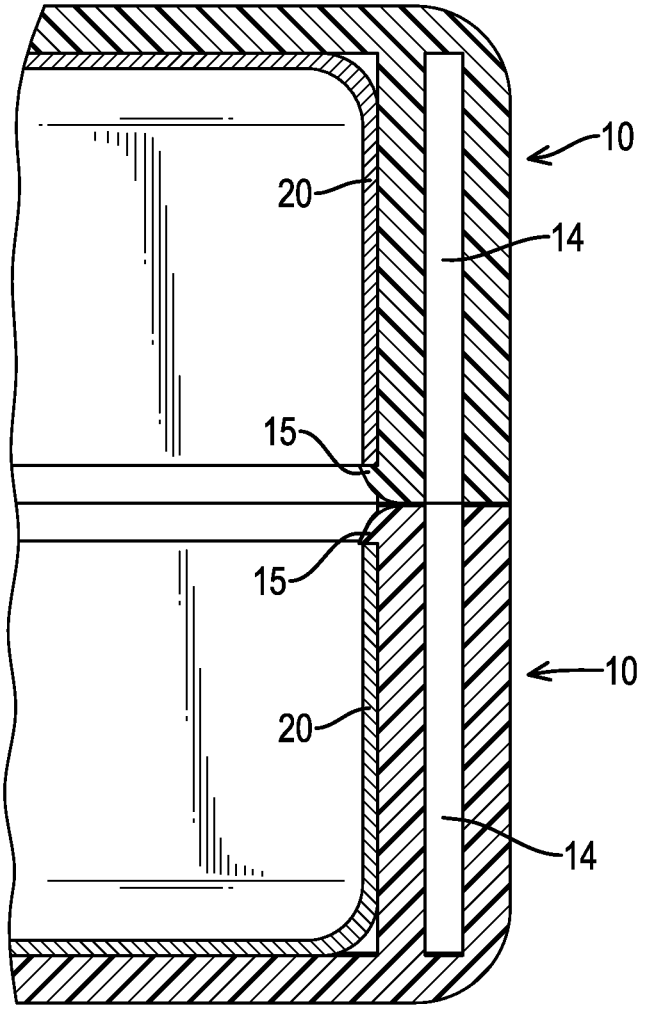
FIG. 6 is a cross sectional side view along the line 6-6 in FIG. 1.

With reference to FIGS. 1 to 6, a preferred embodiment of a collision-resistant tool box in accordance with the present invention has two bodies 10, two inner boxes 20, a connecting set 30, a buckle set 40, and a handle 50.

The structures of the bodies 10 are same with each other. Each body 10 may be made of plastic, is formed as a cubic, and has a side wall 11, a body space 12, a handle trough 13, a collision-resistant space 14, and multiple engaging portions 15. The side wall 11 is formed as a closed structure and may be rectangular. The body space 12 is formed in the body 10 and is surrounded by the side wall 11. The body space 12 has an opening 121 located at a side of the body 10. The handle trough 13 is formed in an outer side of the side wall 11. The collision-resistant space 14 is formed in the side wall 11 along an extension direction of the side wall 11, such that the side wall 11 is formed as a hollow structure. The body spaces 12 of the bodies 10 face and communicate with each other. The engaging portions 15 are formed on an inner side of the side wall 11. Preferably, each body 10 has four engaging portions 15.

The inner boxes 20 are respectively and detachably mounted in the body spaces 12 and are engaged by the engaging portions 15. Each inner box 20 is cubic and may be made of metal or plastic. In use, multiple tools are placed in the inner boxes 20.

The connecting set 30 is connected between the bodies 10 and is located at a side of the body opposite to the handle troughs 13. The bodies 10 are connected to each other by the connecting set 30. The connecting set 30 includes two connecting units 31 mounted on the bodies 10 at an interval.

The buckle set 40 is mounted on the bodies 10 and is located at a side of the body adjacent to the handle troughs 13. The buckle set 40 has two buckle units 41 respectively located at two opposite sides of the handle troughs 13. Each buckle unit 41 can detachably engage with the bodies 10.

Figure 7:
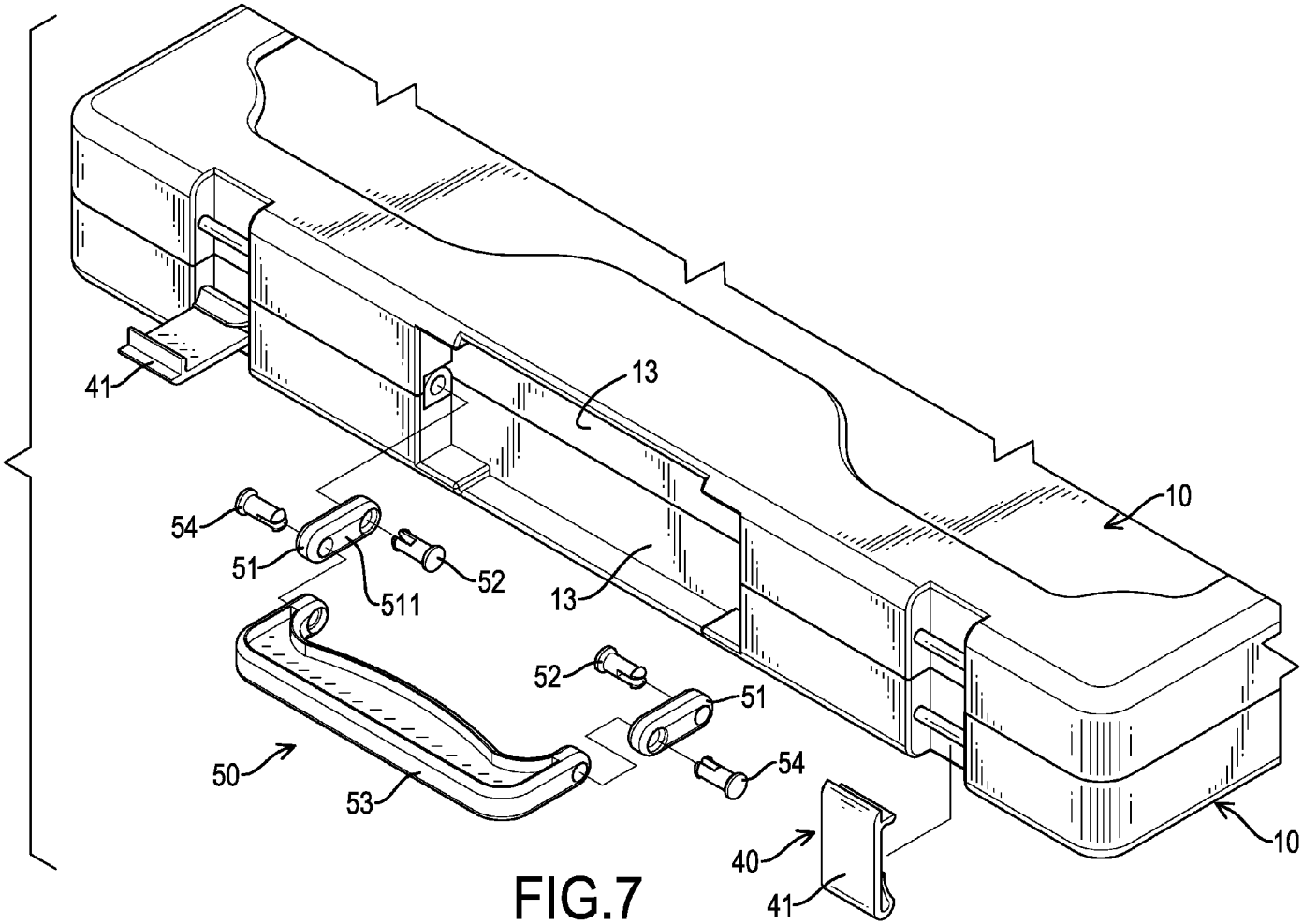
FIG. 7 is a partially enlarged exploded perspective view of the collision-resistant tool box in FIG. 1.

With reference to FIG. 7, the handle 50 is mounted in the handle troughs 13 and has two links 51, two first fixing plugs 52, a handle body 53 and two second fixing plugs 54. The links 51 are mounted in one of the handle troughs 13 and are opposite to each other. The links 51 are pivotally mounted in the corresponding handle trough 13 by the first fixing plugs 52. Each link 51 has a facing side 511. The facing sides 511 of the links 51 face each other. Two ends of the handle body 53 are respectively connected to the facing sides 511 of the links 51. The ends of the handle body 53 are respectively and pivotally connected to the links 51 by the second fixing plugs 54.

In use, the collision-resistant space 14 is provided as a buffer space, such that the bodies 10 are not broken easily upon a collision. The structures of the bodies 10 are same with each other, such that a molding cost of the bodies 10 can be reduced effectively. Furthermore, when one of the bodies 10 is broken, the broken body 10 can be replaced with a new one individually. The tools are placed in the inner boxes 20, so the inner boxes 20 can also protect the tools against impact. Either the body 10 or the inner box 20 can be replaced individually, such that the maintenance cost can be reduced.

Figure 8:
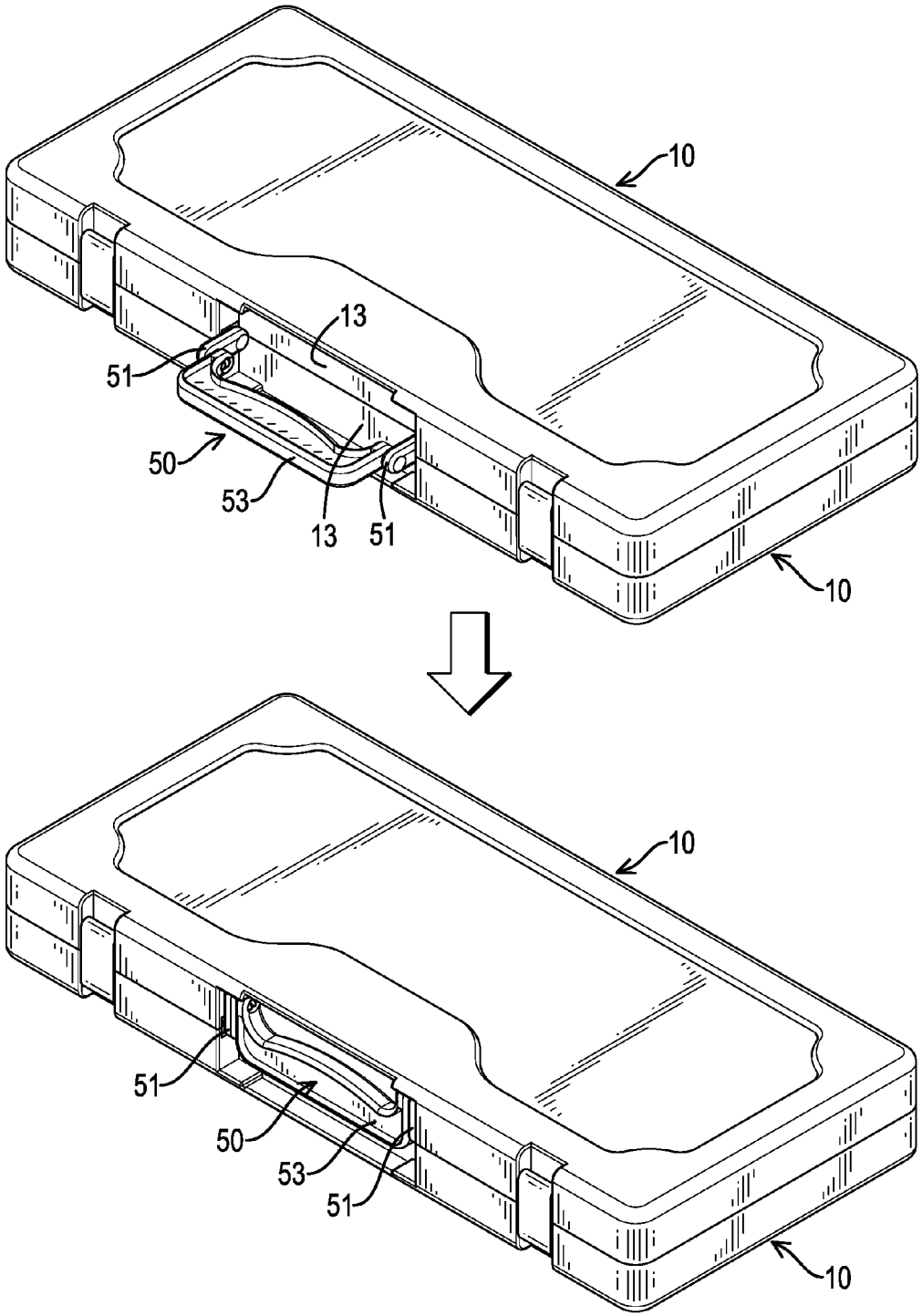
FIG. 8 is an operational view of the collision-resistant tool box in FIG. 1.

With reference to FIG. 8, the links 51 are folded in one of the handle troughs 13. Then, the handle body 53 is folded in a flush state relative to the links 51. The handle body 53 can be flush with the links 51 and is not interfered by the links 51 since the handle body 53 is connected to the facing sides 511 of the links 51. Therefore, the handle 50 can be fully folded in the handle troughs 13 for aesthetic appeal.

From the above description, it is noted that the present invention has the following advantages:

1. The side wall 11 is formed as the hollow structure with the collision-resistant space 14, such that the bodies 10 have the buffer space that can accommodate deformation of the bodies 10 when the bodies 10 are hit by impact. Therefore, the bodies 10 are not broken easily upon collision, and the lifespan of the collision-resistant tool box can be prolonged.

2. Tools are placed in the inner boxes 20, and the inner boxes 20 are detachably mounted in the bodies 10. The bodies 10 can protect the inner boxes 20 from breaking or deforming. When any one of the bodies 10 or the inner boxes 20 is broken, the broken one can be replaced individually, such that the maintenance cost can be reduced effectively. The engaging portions 15 can be engaged with the inner boxes 20 to fix the position of the inner boxes 20 relative to the bodies 10, such that the inner boxes 20 cannot be displaced when the collision-resistant tool box is moved. When the inner boxes 20 are picked up by a user, the user just pulls the engaging portions 15 slightly, and then the inner boxes 20 can be detached from the bodies 10 and can be replaced easily.

3. The handle 50 is mounted in the handle troughs 13 and can be folded fully in the handle troughs 13 to maintain an aesthetic appeal. The structures of the bodies 10 are same with each other, such that the molding cost also can be reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A collision-resistant tool box having:

two bodies, wherein each body has a side wall formed in a closed state;

a body space formed in the body, surrounded by the side wall, and having an opening located at a side of the body, wherein the body spaces of the bodies face and selectively communicate with each other; and a collision-resistant space formed in the side wall along an extension direction of the side wall;

a connecting set connected to a side of each body and connected to the bodies;

a buckle set mounted on a side of each body opposite to the connecting set; and a handle mounted on the side of one of the bodies that is opposite to the connecting set;

each body has a handle trough formed in an outer side of the side wall, and the handle is mounted in the handle troughs of the bodies;

two links mounted in one of the handle troughs and being opposite to each other, wherein each link has a facing side, and the facing sides of the links face each other;

two first fixing plugs respectively inserted into the links and one of the bodies, such that the links are pivotally connected to the handle trough of said body;

a handle body having two ends respectively mounted on the facing sides; and two second fixing plugs respectively inserted into the ends of the handle body and respectively inserted into the links, such that the handle body is pivotally mounted on the facing sides.

2. The collision-resistant tool box as claimed in claim 1 further having two inner boxes respectively and detachably mounted in the bodies.

3. The collision-resistant tool box as claimed in claim 2, wherein each body further has at least one engaging portion formed on an inner side of the side wall, and each inner box is engaged with a corresponding one of the at least one engaging portion.

4. The collision-resistant tool box as claimed in claim 1, wherein structures of the bodies are same with each other.

5. The collision-resistant tool box as claimed in claim 2, wherein structures of the bodies are same with each other.

6. The collision-resistant tool box as claimed in claim 3, wherein structures of the bodies are same with each other.

* * * * *